United States Patent [19]

Prais

[11] Patent Number: 4,990,130

[45] Date of Patent: Feb. 5, 1991

[54] MULTIPLE MOTION CENTRIFUGE

[75] Inventor: A. Wesley Prais, Hewitt, N.J.

[73] Assignee: Becton, Dickinson and Company, Franklin Lakes, N.J.

[21] Appl. No.: 547,711

[22] Filed: Jul. 2, 1990

[51] Int. Cl.[5] ..... B04B 5/02; B04B 9/02

[52] U.S. Cl. ..... 494/20; 366/208; 366/212; 366/240; 494/84

[58] Field of Search ..... 494/16, 17, 20, 21, 494/84, 85, 33, 37, 43; 366/208, 212, 219, 240, 348, 349

[56] References Cited

U.S. PATENT DOCUMENTS

| | | | |
|---|---|---|---|
| 4,589,864 | 5/1986 | Cole | 494/20 |
| 4,659,324 | 4/1987 | Sutton | 494/20 |
| 4,818,115 | 4/1989 | Tornqvist | 366/212 |

*Primary Examiner*—Robert W. Jenkins

*Attorney, Agent, or Firm*—Grindle Robert P.

[57] ABSTRACT

A centrifuge device is provided which may impart selectively controlled centrifugal force to samples under consideration, or a shaking or agitation movement to the samples, as required. A feature of the invention is the use of two roller clutches on the single drive shaft of the device so that a selective movement may be imparted to the samples through the same drive by utilizing a locking mechanism to provide rotation from the shaft in opposite directions. Rotation in one direction causes the imposition of centrifugal force through one clutch, while rotation in the opposite direction causes rotation through the second clutch and the imposition of agitation. In that direction, the sample support mechanism is moved vertically, controlled by a cylinder cam. A further feature of the invention is selective agitation movement and selective degree of agitation through selection of a particular cam profile.

6 Claims, 3 Drawing Sheets

MULTIPLE MOTION CENTRIFUGE

BACKGROUND AND STATEMENT OF THE INVENTION

Generally speaking, this invention relates to a device for imparting centrifugal force to samples in order to separate a heavier and a lighter fraction in each of the samples. More particularly, this invention relates to a device which may utilize both an agitating vertical movement to impart a stirring action to a sample, followed by a centrifugal force applied to the sample. The device of the invention utilizes a single drive for this purpose.

This invention is related to the subject matter in copending U.S. patent application Ser. No. 477,733, filed Feb. 9, 1990, and is hereby incorporated by reference in its entirety.

It is conventional to obtain fluid samples, and particularly body fluid samples, and place them in a centrifuge to separate the heavier and lighter fractions in the sample for subsequent examination and testing for indications of the presence of disease, etc. in the samples taken from an individual. However, in certain circumstances, it is important to impart a stirring action to the sample under consideration prior to the application of centrifugal force. This may be so if a material is added to the sample for reaction with the sample prior to centrifugation and separation of the resulting heavier and lighter fractions. It is to this concept that the present invention is directed.

In certain environments such as the operating room, it has become important to provide facilities for taking body samples of various kinds from an individual, which are worked upon in some manner, and returned to the body in some manner. All of this, as will be understood, must be done fairly rapidly and in a sterile environment.

For example, it has been recognized that human microvascular endothelial cells, i.e., the cells which are derived from capillaries, arterioles, and venules, will function suitably in place of large vessel cells even though there are morphological and functional differences between large vessel endothelial cells and microvascular endothelial cells in their native tissues. Microvascular endothelial cells are present in an abundant supply in body tissue, most notably in fat tissue, and may be used to established a degree of pre-implantation confluence, i.e., at least fifty percent, which should dramatically improve the prognosis of most implants. Thus, fat tissue may be taken from a patient in the environment of an operating room, and that fat tissue acted upon in order to obtain microvascular endothelial cells which may be then implanted on the surface of synthetic grafts which are implanted to substitute for the natural blood carrying vessels in the body.

Although microvessel endothelial cells have been shown to be capable of endothelializing a blood-contacting surface, methods of procuring and depositing these cells in an operating room setting present special considerations.

The microvascular rich tissue is obtained in perinephric fat, subcutaneous fat, or fat associated with the thoracic or peritoneal cavity. This tissue is then subjected to digestion using a proteolytic enzyme, such as collagenase, comprising caseanase and trypsin, which is incubated with the tissue until the tissue mass disperses to reduce a tissue digest. It is during this period, that the invention may be utilized in order to agitate this combination to obtain a certain result. Thereafter, the microvascular endothelial cells are then separated from the digest that has already taken place using centrifugation to produce an endothelial cell rich pellet. The pellet may then be dissolved in an appropriate suspension and the resulting cells applied to the surface of a graft. As a result, an improved graft implant is provided having endothelialized surfaces which are either confluent or which reach confluence guite rapidly (within one population doubling) following implantation.

A special feature of the invention here, as stated above, is that the device of the invention allows digestion with agitation followed by centrifugation, with these movements being selected, as desired in the controls of the single device of the invention. It will be understood, however, that the environment discussed above is not the only environment in which the device of the invention may be used. It may be used, as will be apparent to practitioners-in-the-art, in any application where agitation movement may be required selectively with centrifugation, as required in any process.

With the foregoing and additional objects in view, this invention will now be described in more detail and other objects and advantages hereof will be apparent from the following description, the accompanying drawings, and the appended claims.

DETAILED DESCRIPTION OF THE INVENTION

Figure 1:
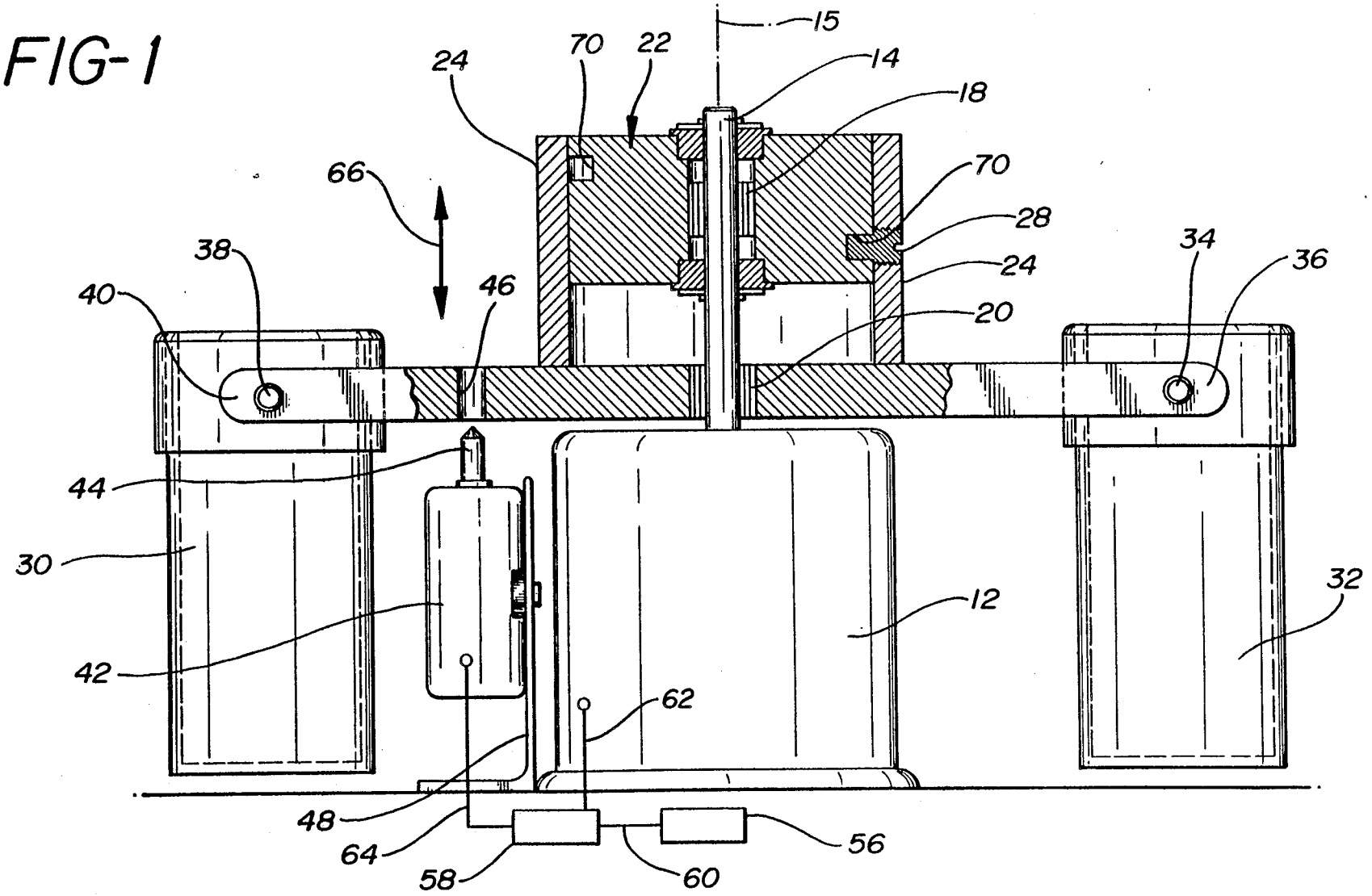
FIG. 1 is a partial sectional view in elevation of the device of the invention.

Referring to the drawings in which like reference characters refer to like parts throughout the several views thereof, FIG. 1 shows a view in elevation and partly in section of a device designated generally 10 which provides for the selective impartation to samples of an agitation and/or stirring movement or centrifugal forces applied to the samples.

In FIG. 1, a reversible electric motor 12 is provided having a drive shaft 14 extending therefrom. Positioned on drive shaft 14 are spaced apart roller clutches 18, 20 with one mounted for movement with shaft 14 in one direction while the other is mounted for rotation with shaft 14 in the opposite direction. In each case, clutches 18, 20 rotate freely on shaft 14 in the opposite direction of their positive drive rotation with shaft 14. Clutch 18 is connected to cylindrical cam 22, while clutch 20 is connected to rotor 16.

Mounted on each end 36, 40, of rotor 16 are sample containing receptacles 30, 32 rotatable around pivots 38, 34, respectively.

As can be seen in FIG. 1, the rotor 16 has a bore 46 therein for receiving a movable rod 44 movable vertically into and out of bore 46 under the action of a solenoid 42. Both electric motor 12 and solenoid 42 are operated from a power source 56 through lines 60 to a control 58. Control 58 controls the on and off and reverse action of motor 12 through line 62, while control 58 controls the action of solenoid 42 through line 64.

When drive shaft 14 is rotated in one direction, clutch 20 grips the shaft 14 and rotates with the shaft 14. In this position, solenoid 42 will be set to withdraw the rod 44 out of the bore 46. Thus, when shaft 14 is rotated, the rotor 16 rotates around axis 15 causing the opposite ends 36, 40 of rotor 16 to rotate around axis 15. This rotation imparts centrifugal force and causes the sample receptacles 30, 32 to swing around axis 15, which in turn causes them to pivot around their respective pivots 38, 34 so that the samples placed in receptacles 30, 32 have imparted to them centrifugal force. This, in turn causes separation of the heavier and lighter fractions in samples contained in receptacles 30, 32. During the course of this rotation, clutch 18 allows shaft 14 to rotate freely within it since it is arranged to grip shaft 14 in the opposite direction.

This rotating movement in one direction causing rotor 16 to rotate around axis 15 also causes vertical annular cam support 24 to rotate around axis 15 in the same direction, together with cam follower 28 and cam 22.

When it is desired to impart an agitation form of vertical movement to samples contained in receptacles 30, 32, control 58 is set to reverse reversible motor 12 so that shaft 14 is rotated in the opposite direction. Prior to this movement of motor 12 and shaft 14, however, solenoid 42 is activated to cause rod 44 to move upwardly into bore 46. The positioning of rotor 16 may need adjustment for this purpose. Such an arrangement fixes rotor 16 in place. This, in turn, fixes annular cylinder cam support 24 in place together with cam follower 28. Thus, none of these parts rotate around axis 15.

When motor 12 is activated to rotate shaft 14 in the opposite direction, therefore, drive shaft 14 rotates freely in clutch 20 while clutch 18 grips drive shaft 14. This causes rotation of cylinder cam 22. As a result, cam 22 is rotated and cam follower 28 follows the cam path or groove 70 in the surface of cylinder cam 22. Continuous rotation of shaft 14 and cylinder cam 22 causes a vertical movement of cam support 24 and rotor 16 according to arrow 66, upwardly and downwardly, according to the specific selected cylinder cam and its particular cam profile.

In this connection, it will be understood that the amount of vertical movement 66 depends upon the particular cam profile selected. Moreover, the sequence of movement relative to the circular movement of cylinder cam 22 is also defined by the cam profile.

Figure 2B:
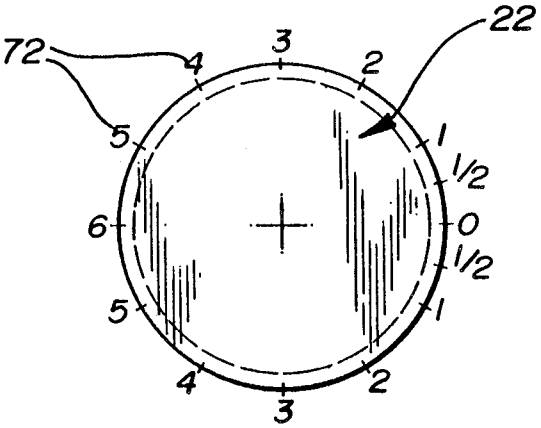
FIG. 2*b* is a top plan view of the cam of FIG. 2*a;*
Figure 2C:
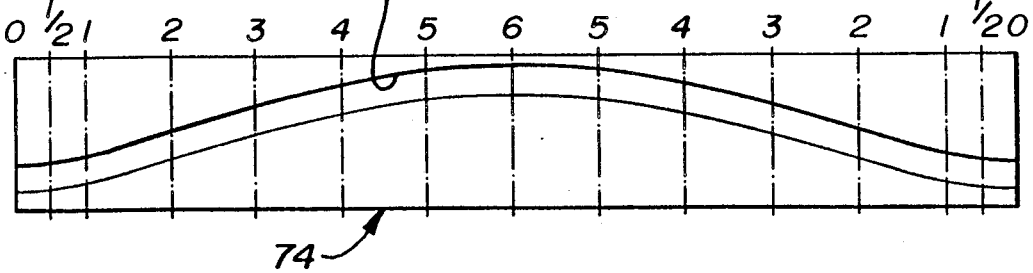
FIG. 2*c* is a cam profile of the cylinder cam of FIG. 2*a* which may be utilized in the device of the invention.
Figure 2A:
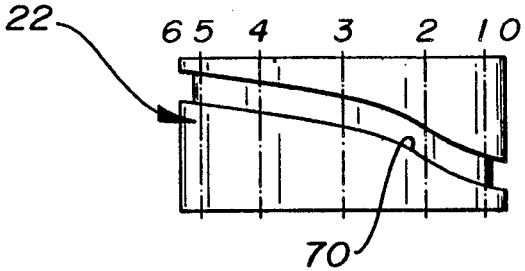
FIG. 2*a* is a side view in elevation of a representative cylinder cam which may be utilized in the device of the invention.

For example and referring to FIG. 2*a*, the cam 22 is shown in side elevation. As can be seen, cam groove 70, in viewing one side of cam 22, has a particular slope which slopes from an upward position at angle 6 to a very low position in the side of the cam at position 0. The actual profile of groove 70 in cam 22 is shown at 74 in FIG. 2*c*. Each individual position 72 such as 1, 2 and 3, in this particular cam profile, provides a 30 degree rotational displacement, as will be understood by practitioners-in-the-art.

Figure 3B:
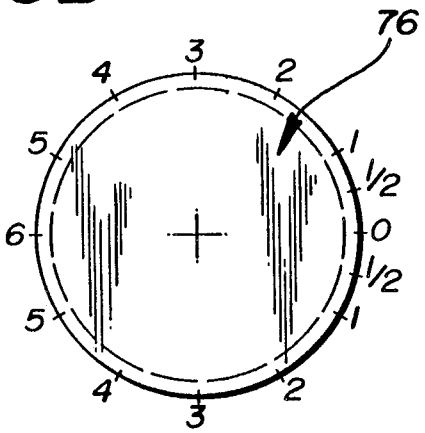
FIG. 3*b* is a top plan view of the cam of FIG. 3*a;*.
Figure 3C:
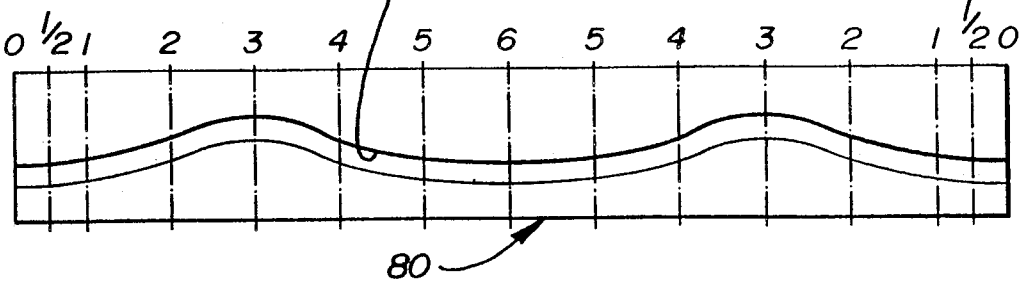
FIG. 3*c* is a profile of the cam of FIG. 3*a.*
Figure 3A:
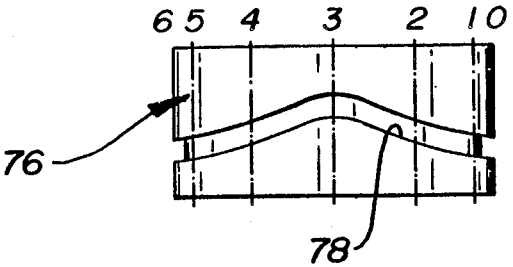
FIG. 3*a* is a side view in elevation of an additional cam which may be utilized in the device of the invention.

Referring now to FIG. 3*a*, a cam 76 is shown in side elevation. In this arrangement, as will be clearly observed, groove 78 follows a different path around cylinder cam 76. As a result, as shown in profile 80 in FIG. 3*c*, cam groove 78 follows an undulating path which has a lesser degree of vertical displacement than groove 70 shown in FIG. 2*c*. Such an arrangement provides a lesser degree of vertical displacement of the samples under consideration and less, but more rapid, agitation, for a given motor shaft rotation.

It is clear, that various cylinder cam profiles may be selected, depending upon the desired agitation required for a particular application. Moreover, it is clear from the arrangement, as discussed herein, that the operator may, selectively, impart centrifugal force to a sample followed by agitation, followed by further centrifugal force, if required. Moreover, this is done with a single drive mechanism utilizing a single reversible motor with all of the mechanism driven by a single drive shaft.

As will be understood by practitioners-in-the art of centrifugal devices of the kind discussed herein, such an arrangement provides a means for imparting the desired characteristics to a particular sample without having to transfer the sample from one place to another. This reduces the amount of equipment required for cell digestion, isolation experiments. This is particularly appropriate in an operating room environment, as discussed above, because the treatment of the samples, as required, may be done much more rapidly and because of a desired sterile environment, much less transfer and handling of the sample is required.

As will be understood further, by practitioners-in-the-art, amplitude, frequency and motion profile are easily changed and precisely controlled with the device of the invention. Moreover, since the entire drive mechanism is incorporated into the centrifuge rotor, in-field service of the drive is limited to simple removal and replacement of the rotor. There are no internal gears, belts, pulleys or bushings relating to the drive mechanism that require special service in the field. This of course, shortens down time and the length of service required if necessary.

While the form of apparatus herein disclosed forms a preferred embodiment of this invention, this invention is not limited to this specific embodiment and changes can be made therein without departing from the scope of the invention which is defined in the appended claims. For example, the control for the reversible motor may have incorporated therein a speed mechanism for increasing or reducing the speed of rotation of the device of the invention. This, in turn, increases or decreases the speed of agitation or the speed of rotation for increasing or decreasing the centrifugal force applied.

What is claimed is:

1. A device for imparting sequentially, centrifugal force or agitation to a fluid sample placed in the device, comprising (a) a source of power;

(b) reversible rotatable motor means;

(c) flow communication means extending between said power source and said rotatable motor means;

(d) control means in said flow communication means for controlling the direction of rotation of said rotatable motor means;

(e) a drive shaft extending from said reversible motor means;

(f) a first clutch mounted on said drive shaft, said first clutch fixed for driving with said drive shaft in a first direction, and freely rotatable on said shaft in a second direction;

(g) a second clutch mounted on said drive shaft, said second clutch freely rotatable on said drive shaft in said first direction, and fixed for rotation on said shaft in said second direction;

(h) a rotor connected to said first clutch;

(i) a cam follower mounted for rotation with said rotor;

(j) a cam connected to said second clutch;

(k) means connected to said control means and movable for preventing rotation of said rotor with said first clutch in said second direction of rotation; and (l) means for supporting fluid samples on each end of said rotor.

2. The device of claim 1, further comprising (a) said rotor is an elongated support rotatable around the axis of said drive shaft; and (b) said means for supporting fluid samples are receptacles pivotally mounted on each end of said elongated rotor, and supported equidistant from said axis of rotation.

3. The device of claim 1, further comprising (a) an annular cam support fixed on said rotor and coaxial with said drive shaft;

(b) said cam being a cylinder cam supported coaxially for rotation in said cam support;

(c) said cylinder cam having a groove extending around the outer circumference thereof;

(d) a cam follower fixed on the internal surface of said annular cam support; and (e) said cam follower extending into said cam groove whereby rotating said cylinder cam causes vertical movement of said annular cam support and said rotor.

4. The device of claim 3, comprising (a) said cam groove has a profile in an undulating pattern extending along the cam surface centrally between the upper and lower surface of said cylinder cam.

5. The device of claim 3, comprising (a) said cam groove has a profile in which said groove extends back and forth from a position immediately adjacent the top surface of said cylinder cam to a position immediately adjacent the bottom surface thereof.

6. The device of claim 1, further comprising (a) said means for preventing rotation of said rotor is a rod connected to a solenoid, and movable into and out of position preventing rotation of said rotor with said first clutch in said second direction of rotation.

* * * * *